United States Patent [19]

Dean

[11] 4,141,555

[45] Feb. 27, 1979

[54] GAME WITH MINIATURE OIL WELL RIG IN A TRANSPARENT DOME

[76] Inventor: Ivan E. Dean, 804 Penn Dr., Friendswood, Tex. 77546

[21] Appl. No.: 856,621

[22] Filed: Dec. 2, 1977

[51] Int. Cl.[2] ..... A63B 71/00; A63H 33/00

[52] U.S. Cl. ..... 273/139; 46/39

[58] Field of Search ..... 35/13; 40/406; 46/39, 46/40; 273/139

[56] References Cited

U.S. PATENT DOCUMENTS

| | | | |
|---|---|---|---|
| 1,796,991 | 3/1931 | Harpham | 40/406 |
| 2,203,183 | 6/1940 | Schuman | 273/139 |
| 2,382,782 | 8/1945 | Eichelberger | 46/39 |
| 3,046,683 | 7/1962 | Buh | 46/39 X |

FOREIGN PATENT DOCUMENTS

| | | | |
|---|---|---|---|
| A71491 | 7/1959 | France | 46/39 |

*Primary Examiner*—Harland S. Skogquist
*Attorney, Agent, or Firm*—Daniel Jay Tick

[57] ABSTRACT

A transparent dome is mounted on a housing and extends from the top thereof. The housing has an oil reservoir, a source of electrical energy, an electric motor and a pump therein operated by the motor for pumping oil. A miniature oil drilling rig is mounted on the top of the housing in the dome and has a tube extending into the housing and into the oil reservoir whereby when adjustably positionable electrical contacts are moved into electrical contact with each other, the motor is energized by the source of electrical energy to operate the pump to continuously pump oil up through the pipe and out at the top of the rig. The oil returns to the reservoir via the dome and oil return slots in the top of the housing.

3 Claims, 2 Drawing Figures

GAME WITH MINIATURE OIL WELL RIG IN A TRANSPARENT DOME

BACKGROUND OF THE INVENTION

The present invention relates to a game.

Games somewhat similar to that described herein are disclosed in the following United States patents. U.S. Pat. No. 1,407,223, issued Feb. 21, 1922 to Rose, U.S. Pat. No. 2,448,151, issued Aug. 31, 1948 to Noel, U.S. Pat. No. 2,960,792, issued Nov. 22, 1960 to Cyrus, U.S. Pat. No. 3,061,313, issued Oct. 30, 1962 to Greene, U.S. Pat. No. 3,539,189, issued Nov. 10, 1970 to Shelton, U.S. Pat. No. 3,801,104, issued Apr. 2, 1974 to Potts et al, U.S. Pat. No. 3,856,307, issued Dec. 24, 1974 to Tinman, U.S. Pat. No. 3,865,379, issued Feb. 11, 1975 to Breslow, U.S. Pat. No. 3,865,380, issued Feb. 11, 1975 to Thomas, U.S. Pat. No. 3,927,886, issued Dec. 23, 1975 to Day, U.S. Pat. No. 3,940,140, issued Feb. 24, 1976 to Meyer et al and U.S. Pat. No. 3,963,243, issued June 15, 1976 to Contento.

Objects of the invention are to provide a game of simple structure, which is inexpensive in manufacture, and provides considerable entertainment, amusement and interest.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
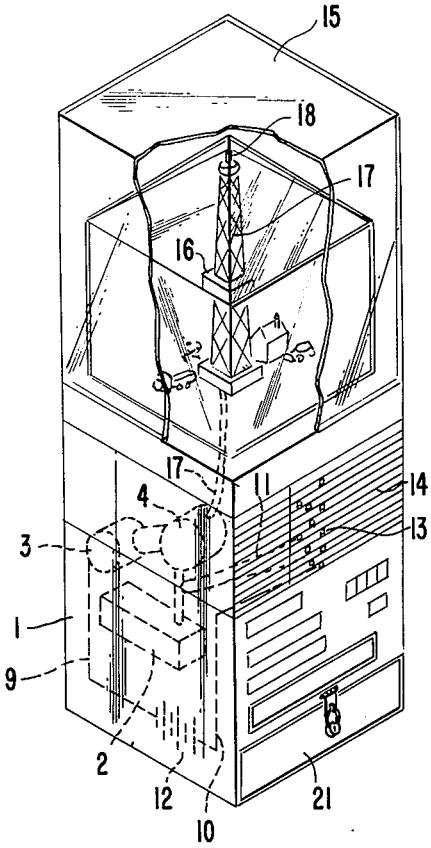
FIG. 1 is a perspective view, partly cutaway of an embodiment of the game of the invention.

The game of the invention comprises a housing 1 having an oil reservoir 2 therein (FIG. 1), an electric motor 3 therein (FIG. 1) and a pump 4 therein operated by the motor 3 for pumping oil from the oil reservoir (FIG. 1). Oil return slots 5, 6, 7, 8, and so on (FIG. 2) are formed in the top of the housing 1 for returning oil pumped out of the housing back into the oil reservoir 2. An electric circuit 9, 10, 11 (FIG. 1) connects the electric motor 3 to a source of electrical energy 12 in the housing via a plurality of adjustably positionable electric contacts 13, as shown in FIG. 1.

Figure 2:
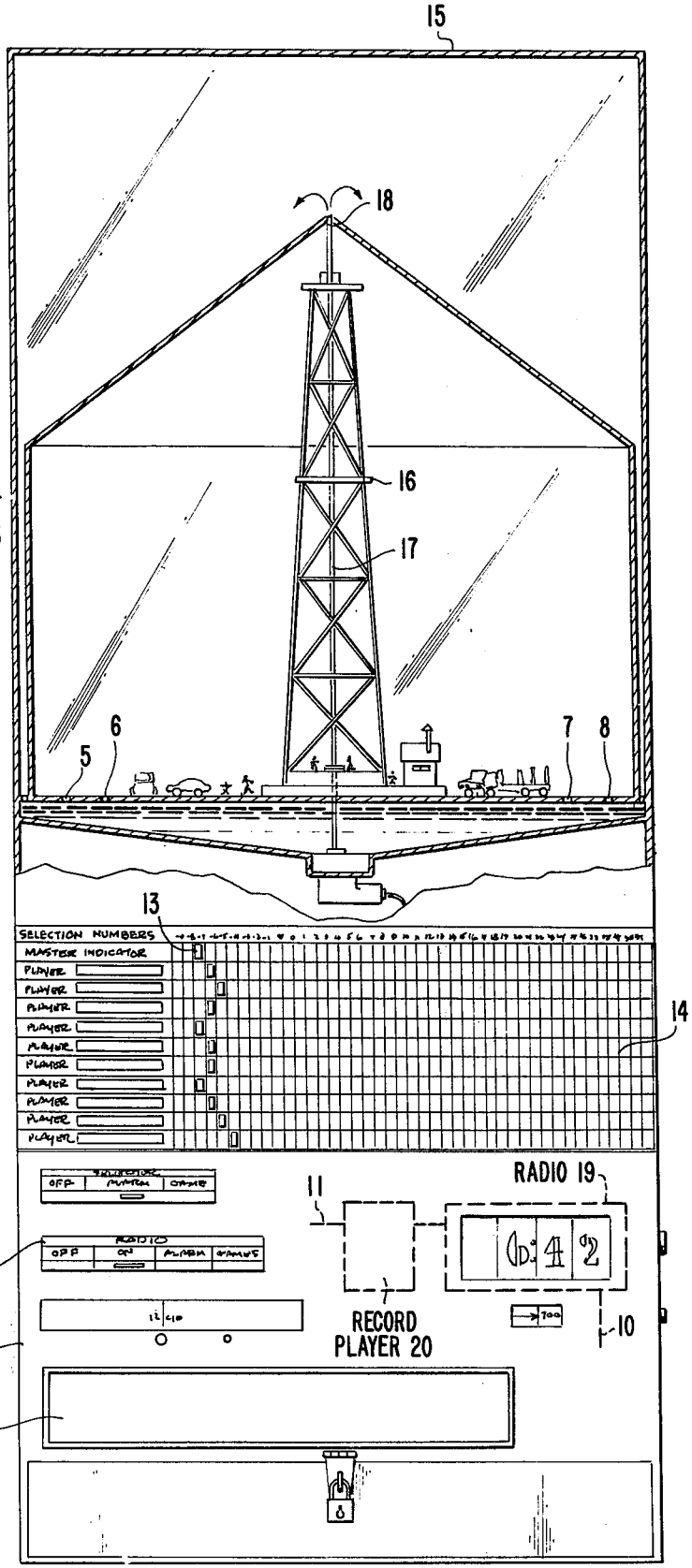
FIG. 2 is a side view, on an enlarged scale, partly cutaway and partly in section, of the embodiment of FIG. 1.

A matrix board 14 is provided on the outside of the housing 1 and has selected ones of the electrical contacts 13 on one side thereof, which is the inside of the housing, and not shown in the views of the FIGS., positioned in accordance with predetermined intelligence. The others of the electrical contacts 13, as shown in FIGS. 1 and 2, are positioned on the other side, or the outside of the housing, in accordance with selections made by players in a manner hereinafter described. Thus, when the intelligence and the selections coincide, the circuit is closed.

A transparent dome 15 of any suitable material such as, for example, clear plastic, is mounted on the housing 1 and extends from the top of said housing, as shown in FIGS. 1 and 2.

A miniature oil drilling rig 16 is mounted on the top of the housing 1 in the dome 15. A tube 17 is provided in the rig and extends into the housing 1 via the top thereof and into the oil reservoir 2 therein, as shown in FIG. 1. Thus, when the electrical contacts 13 on both sides of the housing are moved into electrical contact with each other, the motor 3 is energized by the source of electrical energy 12 to operate the pump 4 to continuously pump oil up through the pipe 17 and out at the top 18 of the rig. The oil then returns to the oil reservoir 2 via the dome 15 and the oil return slots 5, 6, 7, 8, and so on.

A clock radio 19 of any suitable type is provided in the housing and a record player 20 of any suitable type in the housing has a recording of an oil gusher coming in. The radio 19 and the record player 20 are electrically connected in the circuit 9, 10, 11 in a manner whereby when the electrical contacts 13 are in electrical contact, due to coincidence of selections, the recording is played out and reproduces the sound of a gusher coming in.

A sliding drawer 21 is equipped with a very small hasp and eye in which wagers for the games, hereinafter described, may be stored for security. A miniature lock and key is provided.

The radio 19 is small but excellent in quality and has a selector switch 22 (FIG. 2) marked "off," "on," "alarm" and "Game." It has a station selector knob, volume knob and speakers.

When the radio selector knob is "off" the radio does not operate.

When the radio selector knob is "on," power is supplied to the radio and station selection and volume are obtained by use of the appropriate knobs. When the radio selector knob is in the "alarm" position the radio serves as a wake up device in conjunction with the clock.

When the radio selector knob is in the "Game" position the radio is connected to the record player to replay the short tape of the deep rumblings of the underground noises of a gusher in birth. Building in crescendo with the added sounds of drilling pipes clanging together, oil rig shakings and the beautiful sound of the explosiveness of the oil as it bursts forth out ot the top of the rig accompanied by the sounds of the new millionaire shouting with joy. The tape is rewound when the radio selector switch is returned to the "on" position.

After the radio selector is placed in the "Game" position, it is connected for the aforedescribed operation, but will not activate until other steps described in this section under "Games" are taken.

The clock is a high quality time piece with digital presentation and has a standard knob for setting the time and alarm.

When the clock selector is placed in the "off" position, the clock serves strictly as a time piece with the "alarm" and "game" modes inoperable.

When the clock selector is placed in the "alarm" position, the alarm will activate at the time selected on the alarm indicator.

When the clock selector is placed in the "Game" position, a small motor activates the drilling rig into a very slow, peaceful, routine drilling operation with animated activity of the figures and the platform drilling motor, etc. Activity is symbolized by slight motions, but no actual movement out of place of the figures and equipment. This selection is for display and has no other function unless used in conjunction with the radio "Game" selector.

Basically, the radio operates normally as a radio or radio alarm. The clock operates as a clock or an alarm clock. The oil rig scene is routine and quiet. A different and startling scene of noise and activities take place when the games are players and a winner is determined after the stock market final figures for the day are in or the results of a sports contest are final.

The game of the invention is played in the following manner. At any predetermined time of the day, as when the office executives or workers come into work or are in the office for a meeting or whenever a particular group of people decides to make a wager on the results of the Dow-Jones outcome for the day is a good time to play the game. The radio selector switch may be in any position except "Game." The clock selector may be in any position. The contacts 13 on both sides of the housing are aligned. The player writes or prints his name on one of the opaque spaces to the right of the word "Player" on the matrix 14.

A plastic selector cover on the matrix 14 is slipped out to the right and the player moves the corresponding electric contact 13 to indicate the change he expects the Dow-Jones average will decrease or increase in points at the end of the day. He then slides the plastic selector cover back into its groove and thus his selection is known only to himself. Thus, for example, Jim may select up 4 points, Bill up 2 points, Bob down 2 points, Joe up 8 points, etc. Ralph may select no change and slides his plastic selection cover back into place to conceal his selection. John and Mark may make their selections and slip the plastic selection covers back in place concealing their selections from other players. Any wagers to be made are made in play money provided for the purpose and are placed in the drawer 21 to be disbursed when the results are known at the end of the day.

After the Dow close is known, the group gathers around the gusher.

The master electric contact 13 on the inside of the housing is moved to the correct figure such as, for example, up 8 points, the selector on the radio is moved to "Games" position, and since Joe has selected up 8 points with his electric contact 13, the oil rig comes to life activated by the combination of Joe's contact closing the electrical circuit with the master contact which has been moved to the up 8 points. The power circuit is closed when the radio selector switch is placed in the "Games" position.

When the circuit is closed, the light behind Joe's name flashes on and off, the rig starts its vibrations and builds up to a crescendo as the pump 4 starts pumping the oil up the pipe 17 of the rig 16. The oil gushes out of the top 18 of the rig 16, splashing against the top of the dome 15 and running down said dome, through the oil return slots 5 to 8, and so on, to return to the oil reservoir 2 for recirculation.

All players who selected the correct number are identified by the lights flashing on and off next to their names and the play money may be split or otherwise disbursed as previously agreed to by the participants. In the described example, however, Joe wins the money and the rig is returned to normal operation.

If there is no winner, the master electric contact 13 does not close the circuit because no one has moved his electric contact 13 along the electrically conductive strip to the correct number. The rig continues its quiet operation. The money may be returned to the participants or they may leave it in the drawer 21 to enlarge the pot the following day.

Most games may be wagered on, using the same number selection hereinbefore as described. Only the numbers 0 through 9 are generally required. Thus, for example, the group may gather before a football game or other sporting event. Each player selects the number he thinks will be the total final score, regardless of the winning team. Again, only the numbers 0 through 9 are needed because if a player thinks the score wil be 14 to 7 then he adds the last two numbers of his selected score (ie, $4+7=11$) so he believes it will end in a 1 and he moves his electric contact 13 to its "1" position. He could also win on any number of combinations where the last two numbers of the final score end in "1". For example, he would win on 8 to 3, 9 to 3, 21 to 0, 41 to 20, 18 to 13, 43 to 28, etc.

If 0 is selected a player could win on 18 to 12, 30 to 10, 7 to 3, 48 to 32, etc.

The same procedures are used in setting the game up and determining the winner, as hereinbefore described.

The same rules apply to baseball, basketball, etc. games.

While the invention has been described by means of a specific example and in a specific embodiment, I do not wish to be limited thereto, for obvious modifications will occur to those skilled in the art without departing from the spirit and scope of the invention.

I claim:

1. A game, comprising a housing having an oil reservoir therein, a source of electrical energy therein, an electric motor therein, a pump therein operated by the motor for pumping oil, oil return slots in the top thereof for returning oil pumped out of the housing back into the oil reservoir and an electric circuit connecting the electric motor to the source of electrical energy via a plurality of adjustably positionable electric contacts;

a transparent dome mounted on the housing and extending from the top thereof; and a miniature oil drilling rig mounted on the top of the housing in the dome, said rig having a tube extending into the housing via the top thereof and into the oil reservoir therein whereby when the electrical contacts are moved into electrical contact with each other the motor is energized by the source of electrical energy to operate the pump to continuously pump oil up through the pipe and out at the top of the rig, the oil returning to the oil reservoir via the dome and oil return slots.

2. A game as claimed in claim 1, further comprising a matrix board on the outside of the housing having selected ones of the electrical contacts on one side thereof positioned in accordance with predetermined intelligence and the others of the electrical contacts on the other side thereof positioned in accordance with selections made by players whereby when the intelligence and the selections coincide, the circuit is closed.

3. A game as claimed in claim 2, further comprising a clock radio in the housing and a record player having a recording of an oil gusher coming in electrically connected in the circuit in a manner whereby when the electrical contacts are in electrical contact due to coincidence of selections the recording is played out.

* * * * *